United States Patent [19]

Wesselink et al.

[11] 4,260,931

[45] Apr. 7, 1981

[54] LOW-PRESSURE MERCURY VAPOR DISCHARGE LAMP WITH LUMINESCENT COATINGS ON ENVELOPE WALLS

[75] Inventors: Gustaaf A. Wesselink; Hendrik Roelofs; Cornelis H. M. Van Bommel, all of Eindhoven, Netherlands

[73] Assignee: U.S. Philips Corporation, New York, N.Y.

[21] Appl. No.: 11,470

[22] Filed: Feb. 12, 1979

[30] Foreign Application Priority Data

Feb. 14, 1978 [NL] Netherlands ..... 7801636
Dec. 27, 1978 [NL] Netherlands ..... 7812539

[51] Int. Cl.[3] ..... H01J 61/35; H01J 61/42

[52] U.S. Cl. ..... 313/493; 313/204; 313/220

[58] Field of Search ..... 313/493, 485, 204, 220

[56] References Cited

U.S. PATENT DOCUMENTS

| | | | |
|---|---|---|---|
| 2,457,503 | 12/1948 | Singer | 313/485 |
| 3,457,447 | 7/1969 | Menelly et al. | 313/488 X |
| 3,899,712 | 8/1975 | Witting | 313/493 |
| 4,095,135 | 6/1978 | Yamazaki et al. | 313/493 |

FOREIGN PATENT DOCUMENTS

| | | | |
|---|---|---|---|
| 565602 | 9/1958 | Belgium | 313/485 |
| 906245 | 3/1954 | Fed. Rep. of Germany | 313/493 |
| 1047419 | 7/1953 | France | 313/485 |
| 36656 | 9/1955 | Poland | 313/485 |

*Primary Examiner*—Palmer C. Demeo
*Attorney, Agent, or Firm*—Robert S. Smith

[57] ABSTRACT

Low-pressure mercury vapor discharge lamps of the fluorescent type are known which comprise two nesting glass members so grooved as to provide between their nesting surfaces a circuitous ("folded") discharge path between two electrodes, the length of the discharge path being considerably greater than the physical distance between the electrodes. The whole surface of each glass member is coated with luminescent material with the result that, when the lamp is in use, the portions of the members not surrounding the discharge appear dark due to their poor light transmissibility. According to the invention, these portions of the two members are not coated with luminescent material and thus act as windows for light generated in the luminescent layers facing the lamp axis. Preferably, a fluted reflector is provided inside the lamp.

10 Claims, 8 Drawing Figures

Figure 1:
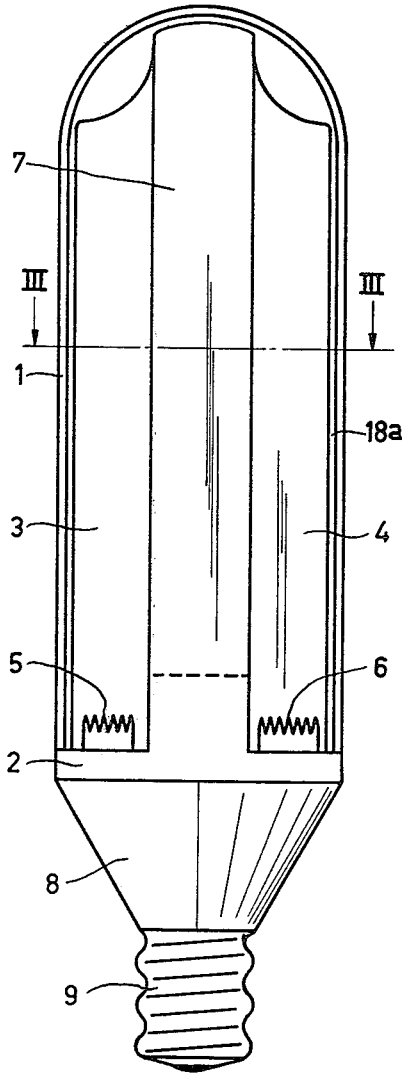

LOW-PRESSURE MERCURY VAPOR DISCHARGE LAMP WITH LUMINESCENT COATINGS ON ENVELOPE WALLS

The invention relates to a low-pressure mercury vapor discharge lamp comprising a hollow inner member surrounded by an outer member. The wall of at least one of the members has one or more grooves and the intervening portions of that member located between the grooves extending to or near to the wall of the other member. A folded discharge path is thus formed by means of the grooves, is present, the walls of the discharge space being coated with luminescent material. Such a lamp is disclosed in U.S. Pat. No. 3,899,712.

Folding the discharge path results in a compact low-pressure mercury vapor discharge lamp. If provided with a suitable lamp base such lamps are suitable for use in luminaires for incandescent lamps for general lillumination purposes.

The above-mentioned United States Patent describes a low-pressure mercury vapor discharge lamp whose discharge path is extended by a circuitous route between the electrodes. The shape of the discharge path is mainly determined by a helically-shaped grooved profile in a glass lamp envelope. At the side facing the lamp axis the grooved profile is limited by the wall of a truncated cone. In accordance with the United States patent the two members are tapered to prevent the discharge from short-circuiting and both members nest closely together. According to this patent such lamps can be easily mass produced. The outer side of the inner member of the lamp described in the Patent, as well as the inner side of the outer member, is provided, preferably over its entire surface area, with a thick layer of luminescent material. In accordance with the Patent it is also possible to provide the inner member with a reflecting layer between the luminescent layer and the wall of the member to prevent loss of light towards the inside of the lamp where a stabilization ballast is present.

A drawback of the known lamp is that dark stripes are visible at the outside of the lamp on the portions located between the grooves, because these portions do not contribute to the emission of light. This results in a less attractive appearance of the lamp and has a detrimental influence on the luminous flux of the lamp. Besides that, although the risk for short-circuiting of the discharge is reduced owing to the fact that both bodies taper, it is possible that when the inner member is slid into the outer member (to a nested relationship) the luminescent layer or the reflecting layer may be damaged.

It is an object of the invention to provide a low-pressure mercury vapor discharge lamp which can be easily produced, has a high luminous flux per unit of lamp volume, as well as such a shape that it can be easily used in existing luminaires for conventional incandescent lamps.

In accordance with the invention a low-pressure mercury vapor discharge lamp of the type defined in the preamble is characterized in that the intervening portions located between the grooves face and extend parallel to the wall of the other member. These intervening portions and the adjacent portions of the other member located opposite to the intervening portions are free of luminescent material.

A lamp according to the invention has a high luminous flux per unit of lamp volume because the light can leave the lamp without obstruction in substantially all directions, so also the light emitted into the direction of the longitudinal axis of the lamp. This is the result of the fact that the ultraviolet resonant radiation of mercury, converted into visible light by the luminescent layers located on the wall of the grooves, leaves the lamp through the hollow space located in the inner member and through the end faces. This results in a sort of light output windows.

The end faces of the grooved member extend to or to near the wall of the other member. Each member may bear upon the other in the region of the end faces, but this is not necessary. Preferably a gap of not more than 2.0 mm is present between the end faces and the other member. With such a gap the discharge space is closed in a discharge-tight manner, that is to say no short-circuiting of the discharge through the gap can occur. An advantage of this embodiment is that both members can be slid over one another during production of the lamp without damaging luminescent layers. Accordingly the two members need only be sealed in a gas-tight manner near the ends, for example by means of sealing glass. In addition, the presence of these gaps facilitates the so-called "pumping" (evacuation) of these lamps during manufacture. Such a lamp, which is d.c. operated, has the further advantage that the depletion of mercury at the anode, resulting from the fact that the (positive) mercury ions have moved towards the cathode during operation of the lamp (cataphoresis effect) is counteracted by mercury transport through the narrow gap towards the anode region.

The groove pattern provided on one of the members is decisive for the ultimate shape of the discharge path. In general it is advantageous for the luminous flux and the efficiency of compact discharge lamps that the discharge path is relatively long. Preferably the grooves (and consequently the end faces) of a lamp according to the invention have the shape of a helix, or the grooves extend substantially into the longitudinal direction of the lamp.

The groove pattern may be disposed in the outer member, the inner member then generally being of a cylindrical shape. In such an embodiment the discharge path is limited by the walls of the portions, located between the grooves, of the outer member and the outer surface of the inner member. In a preferred embodiment of a lamp according to the invention, however, the inner member is provided with grooves and the outer member is a cylindrical lamp envelope. These lamps are only little vulnerable by fracture because the grooves are in the inner body.

Measured along the circumference of the inner body the width of the grooves in lamp types having longitudinal grooves is preferably about equal to the width of the end faces. It was found that the luminous flux per unit of lamp volume is optimal at this ratio.

In an other embodiment of a lamp according to the invention a reflecting member is present in the inner member. The reflecting member consists, for example, of a glass tube coated at the outside with a reflecting layer, such as magnesium oxide. Alternatively, the reflecting member may consist of aluminium. A lamp of this construction has a very uniform light distribution. The luminous flux can be increased and the uniform light distribution can be improved by fluting the reflecting member in the direction of the end faces (the intervening portions). In this manner the visible light, converted by the luminescent layers, directed in the direction of the longitudinal axis of the lamps is reflected towards said end faces (the "light-output windows"). Such hollow reflecting members have sufficient room for an electric stabilization ballast and/or a starter. It is then not necessary to apply additional provisions for housing said electric units in the incandescent lamp luminair itself.

A special embodiment of a lamp according to the invention is characterized in that the end faces and/or the portions, located opposite the end faces, of the other member, have a refraction profile. This profile which can be applied to either the inner wall or the outer wall consists of, for example, a pattern of ribs extending parallel to the discharge path and being prismatic in cross-section.

The rays of light coming from the grooves and transmitted towards the end faces are refracted so that a lamp having a uniform light distribution and an intense brightness is obtained. It is, alternatively, possible for the refraction profile to consist of frosted glass having a high transmission coefficient for light.

Lamps according to the invention may be used as an alternative for incandescent lamps. Besides the fact that the dimensions are of the same order as those of incandescent lamps, the efficiency of the discharge lamps is several times higher. By means of a suitable choice of the luminescent material it is possible to achieve in lamps according to the invention a color temperature which substantially corresponds to that of the incandescent lamp. This renders the use of discharge lamps according to the invention in living rooms attractive.

Embodiments of the invention will now be further explained by way of example with reference to the accompanying drawings in which FIG. 1 shows a compact low-pressure mercury vapor discharge lamp in which the inner member is provided with grooves extending into the longitudinal direction of the lamp.

Figure 2:
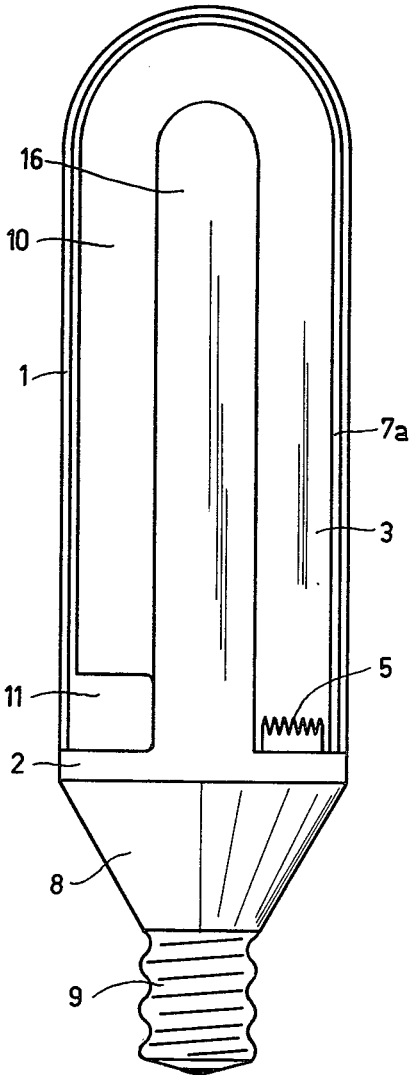
Figure 3:
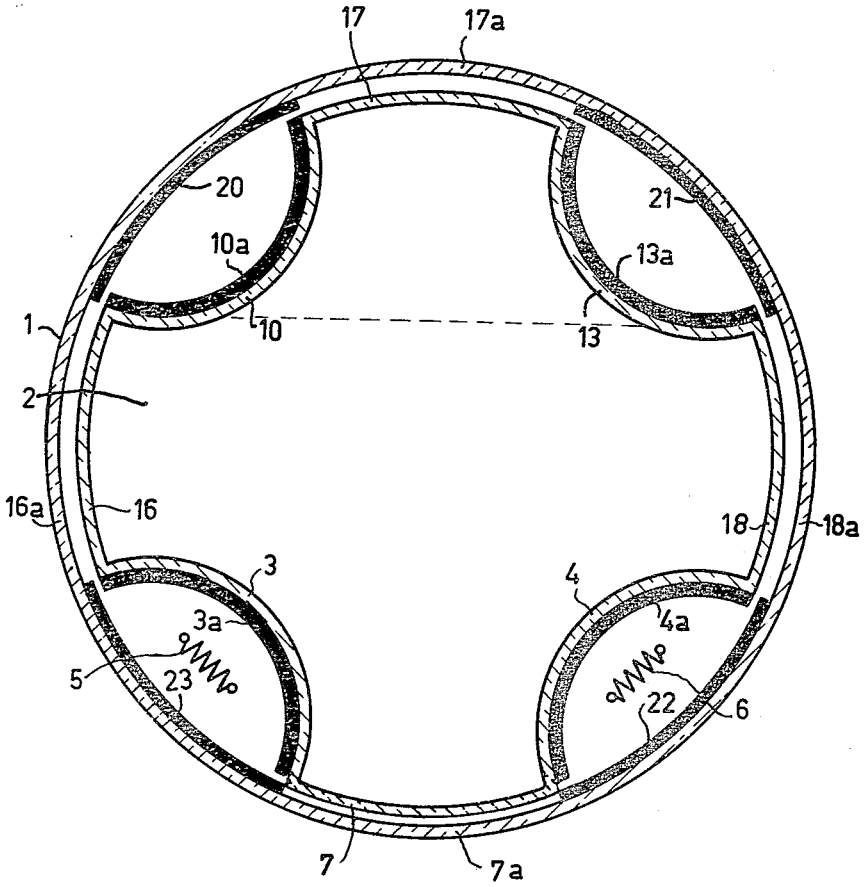
Figure 4:
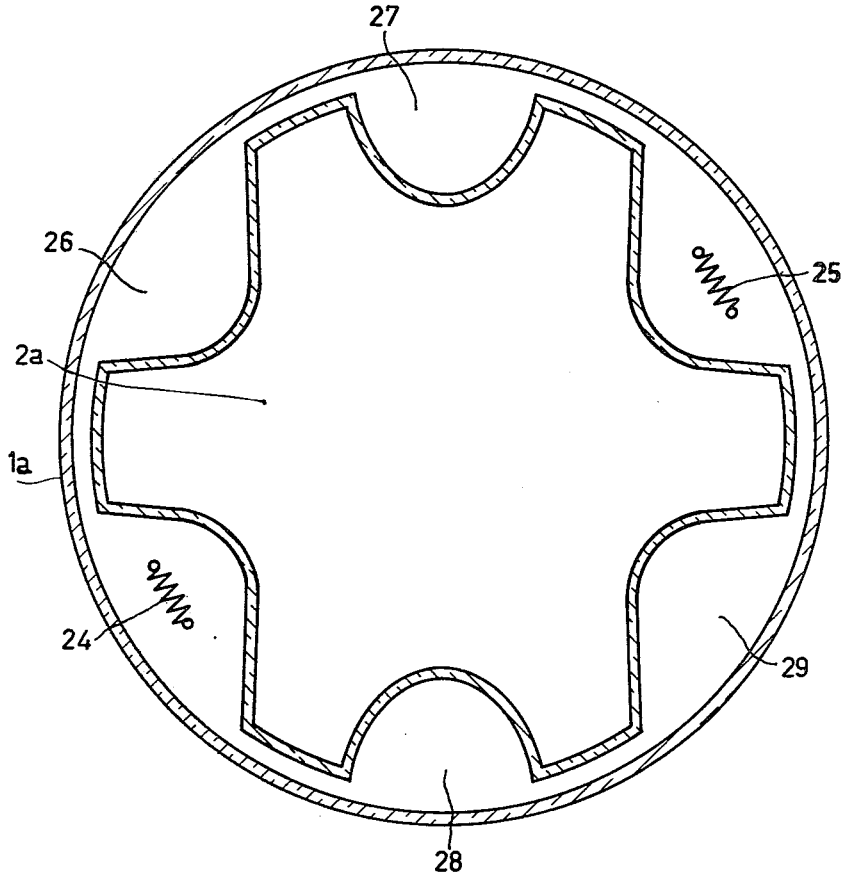
Figure 5:
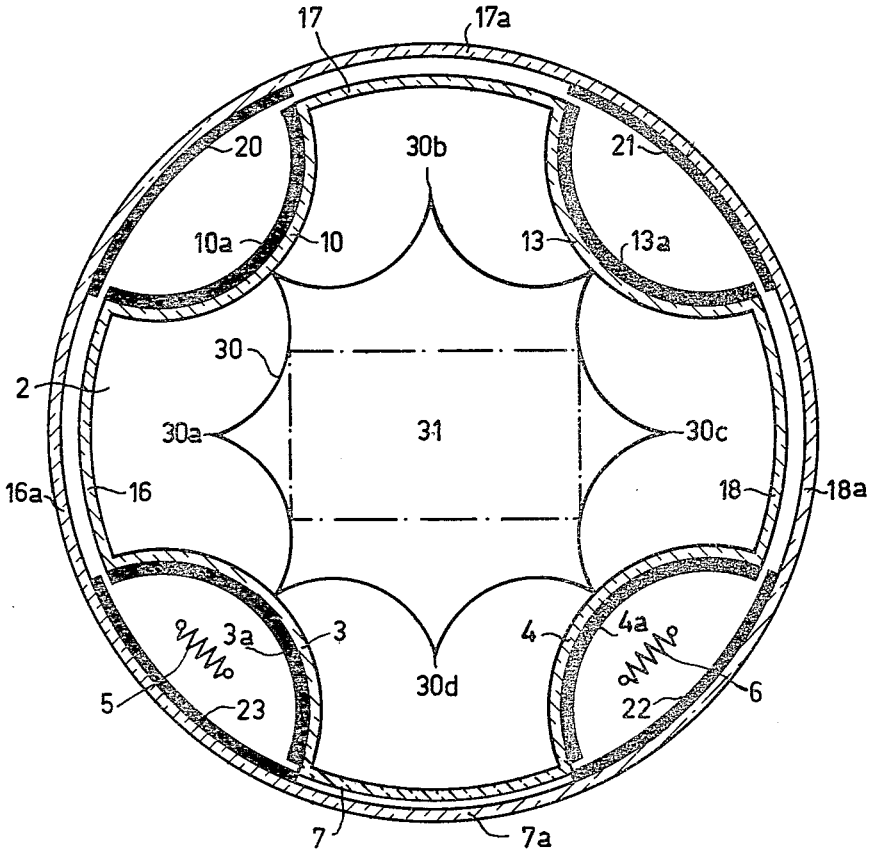
Figure 6:
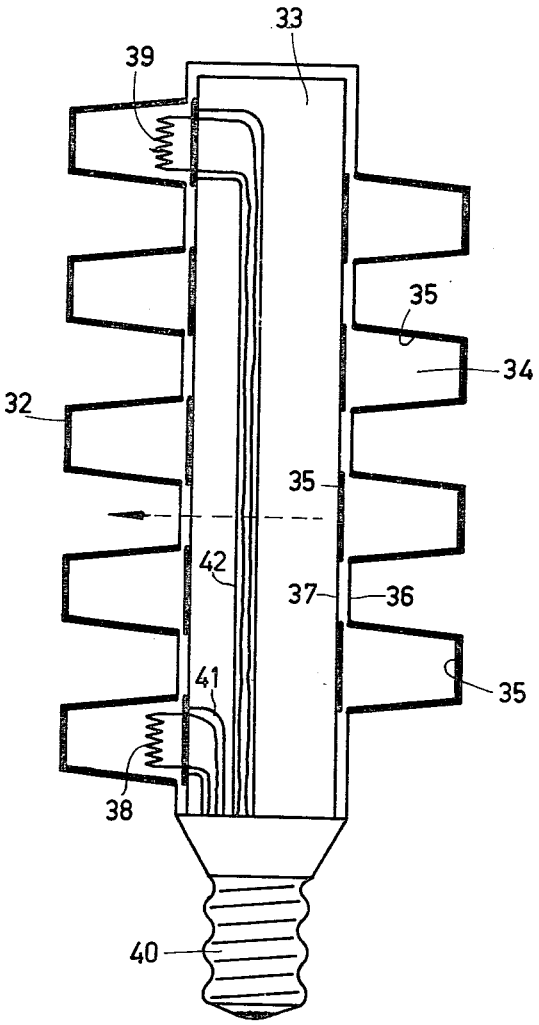

FIG. 2 shows a side view of the same lamp,

FIG. 3 is a cross-sectional view taken along the plane III—III of a lamp shown in FIG. 1, FIG. 4 is a cross-sectional view of a lamp according to the invention, the inner member having six grooves, FIG. 5 is a cross-sectional view of a lamp shown in FIG. 1 or 2, a reflector being disposed in the inner member, and FIG. 6 shows diagrammatically a longitudinal section of an embodiment of a lamp according to the invention, the outer member having a helical-shaped groove pattern.

Figure 7:
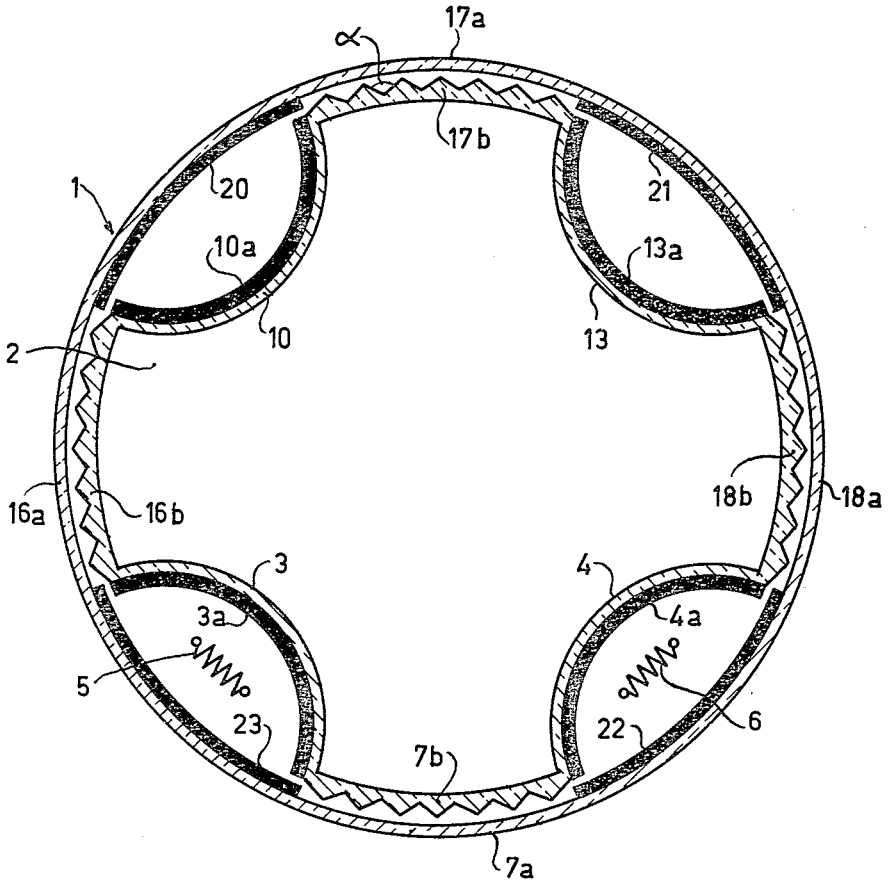
Figure 8:
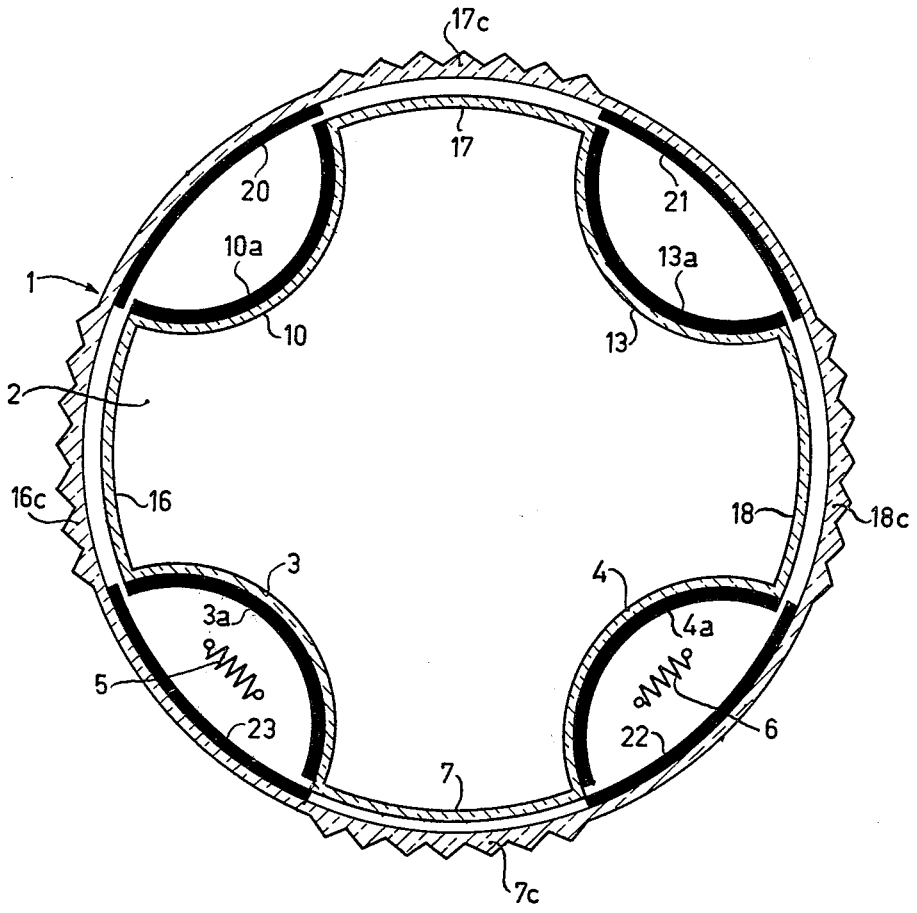

FIG. 7 is a cross-sectional view as shown in FIG. 3, the end faces having been provided with a refraction profile, FIG. 8 is also a cross-sectional view as shown in FIG. 3, a refraction profile having been provided on the portions of the outer wall of the outer body, located opposite the end faces.

The lamp shown in FIG. 1 comprises a cylindrical lamp envelope 1. The lamp envelope comprises a hollow cylindrical glass inner member 2 provided in the longitudinal direction with four grooves, two of which (3 and 4) are shown in FIG. 1. The discharge path is folded between the electrodes 5 and 6 and is limited by the wall of the grooves and the lamp envelope. Only the grooves and the portions of the lamp envelope facing the discharge, are coated with a layer of luminescent material, consisting of a mixture of three phosphors, namely blue-luminescing bivalent europium - activated barium magnesium aluminate; green-luminescing terbium-activated cerium magnesium aluminate and red-luminescing trivalent europium-activated yttrium-oxide. The intervening portions or end faces (a front view of one of them is shown in the drawing, denoted by 7) of the inner member 2, which are located between the grooves (such as 3, 4), extend to near the wall of the lamp envelope 1 and are parallel thereto. these intervening portions and the portions of the lamp envelope facing them are free of luminescent material (see also FIG. 3). In this manner these portions form "light-output windows". In a particular embodiment, the lamp is approximately 12 cm long. The diameter of the lamp envelope is approximately 5.5 cm. The depth of the grooves in which the discharge is present is approximately 1.5 cm. The end faces are 1.8 cm wide. The overall length of the discharge path is approximately 40 cm. The intervening portion 7, located between the two electrodes, is at a distance of 0.2 mm from the wall of the lamp envelope 1, while the remaining intervening portions (7*a*) are spaced approximately 1.0 mm from the lamp envelope. The lamp contains mercury at a pressure of $6\times10^{-3}$ Torr as well as a rare gas mixture of argon and neon (75 −25% by vol.) at a pressure of 2.5 Torr. At an applied power to the lamp of 25 Watts and an operating voltage of 100 V the lamp had an efficiency of 63 lm/W. Lamp base 8 has room for an electric stabilization ballast and/or a starter. A connector sleeve 9 is fastened to the lamp base so that the lamp can be fitted in a luminair for incandescent lamps.

FIG. 2 shows a side view of a lamp of FIG. 1. The reference numerals are the same as in FIG. 1. The discharge path extends from electrode 5 upwards through groove 3 and downwards through groove 10, transversely, through an opening 11 upwards via another groove 13 (not shown) whereafter it extends downwards again towards the other electrode (6) via groove 4.

FIG. 3 shows a cross-sectional view of a lamp of FIG. 1 along the plane III—III. The hollow glass inner member 2 is provided with four longitudinal grooves 3, 4, 10 and 13 in which the discharge is present. The intervening portions 7, 16, 17 and 18 of the inner member 2 located near the lamp envelope 1 and also the corresponding adjacent portions 7*a*, 16*a*, 17*a* and 18*a* of the lamp envelope 1 are free of luminescent material and form the so called "the light-output windows". The portions, facing the discharge, of the wall of the grooves and the lamp envelope are coated with luminescent powder. The 2nd portions of the grooves are denoted by 3*a*, 4*a*, 10*a* and 13*a*, respectively, while the portions of the lamp envelope located opposite the grooves are denoted by 20, 21, 22 and 23 (also coated with luminescent powder). Measured around the circumference of the lamp envelope the width of the luminescent layers, such as 20, is substantially equal to the width of the uncoated portions, such as 17*a*. In this manner, light which passes into the hollow inner member can leave the lamp through the "light-output windows" (16, 16*a*) since these windows are free of luminescent powder.

The lamp described above can be produced by sliding the cylindrical lamp envelope 1 over the inner member 2 and by thereafter sealing their bottom ends together, for example by means of sealing glass. The grooved inner member 2 can be blown in a single operation inside two facing molds, of graphite or chromium nickel steel in which the groove pattern is provided. Depending on this groove pattern a compact lamp is obtained having a folded discharge path comprising four or more parallel sections.

FIG. 4 shows a cross-sectional view near the base of a lamp 1*a*, the inner member 2*a* having been provided with grooves in a similar manner as for the lamp described in FIG. 3, the difference being that in this case the discharge path has been folded five times between the electrodes 24 and 25, resulting in six parallel grooves, extending in the longitudinal direction of the lamp. From electrode 24 the discharge path travels upwards (i.e. in the direction vertically upwards towards the viewer), returns via groove 26, travels via an opening near the base upwards again through groove 27 downwards through groove 28, then via an opening into groove 29 upwards through groove 29 and, finally, downwards again to electrode 25. Six intervening windows are consequently created in this lamp. In this embodiment the discharge path is relatively long so that the operating voltage of the lamp increases and the relative electrode losses decrease. As a consequence thereof the efficiency of the lamp and the electric ballast increases for the same applied power. In a practical embodiment the envelope of the lamp is approximately 8 cm long and the diameter of the lamp envelope (the outer member) is approximately 6 cm. The overall length of the discharge path is approximately 40 cm. The grooves are approximately 0.9 cm deep. The width of the intervening portions or end faces is approximately 1.2 cm. With the same luminescent materials, rare gas composition and rare gas pressure as for the lamp described in FIG. 1 the lamp efficiency was 60 lm/W at an applied power to the lamp of 20 W.

FIG. 5 is a cross-sectional view of a lamp shown in FIG. 3 but with a hollow reflecting member 30 provided in the inner member 2. This member, consisting of reflecting aluminium foil is fluted in the direction of the grooves and "windows" 7, 16, 17 and 18 so that an optimum reflection of the light coming from the grooves is effected towards said windows. The peaks of the pairs of flutes cooperating with windows 16 to 20 are denoted by 30*a*, 30*b*, 30*c* and 30*d* respectively. Inside the reflector member there is sufficient space to accommodate an electric stabilization ballast 31, shown by means of dotted lines.

In FIG. 6 a continuous helical groove 34 is provided in an outer member 32, the discharge being present in the groove 34 limited by the wall of the outer member 32 and cylindrical, hollow glass inner member 33. Only those portions of the walls, of the outer and inner members which enclose the discharge path are coated with luminescent powder 35. The helical portions of the walls not coated with luminescent powder are denoted by 36 and 37. These portions form light-output windows wherethrough the light generated by layer 35 can leave the lamp unobstructedly (see arrow). The lamp is provided with two electrodes 38 and 39 housed in glass tubes 41 and 42 and a cap 40, by means of which the lamp can be fitted in an incandescent lamp luminaire. This cap comprises, for example, a starter and/or an electric ballast. In a practical embodiment diameter of the inner member 33 was 20 mm and the larger diameter of the outer member 32 approximately 60 mm. The overall length of the discharge path was about 60 cm. The intervening portion 36 was approximately 1.0 cm wide. When using the previously mentioned luminescent materials and rare gasses, the efficiency of the lamp was 65 lm/W at an applied power to the lamp of 30 W and an operating voltage of 150 V.

In the FIGS. 7 and 8 components corresponding to those in FIG. 3 (FIGS. 1 and 2, respectively) have been given the same reference numerals. In the cross-sectional view of a lamp according to the invention, shown in FIG. 7, the outer wall of the end faces of the inner member 2 has been provided with a refraction profile (7*b*, 16*b*, 17*b* and 18*b*), which has a high transmission coefficient for light. This refraction profile has a plurality of ribs extending parallel to the discharge path (in the longitudinal direction of the lamp). The ribbed structure has for its effect that the rays of light coming from the grooves 3, 4, 10 and 13 are refracted so, owing to the prismatic operation thereof, that the lamp has a uniform light distribution. The angle $\alpha$ of the profile between the upright edges of the adjacent ribs is approximately 120°.

In the cross-sectional view shown in FIG. 8, the portions of the cylindrical glass outer member 1, located opposite the end faces, have been provided on the outside with a refraction profile in the form of ribs. These profiles are denoted by 7*c*, 16*c*, 17*c* and 18*c*. Also in this embodiment the angle of the profile is approximately 120°.

What is claimed is:

1. A low-pressure mercury vapor discharge lamp comprising a hollow inner member surrounded by an outer member, the wall of at least one of the members having one or more grooves, the intervening portions of that member located between the grooves extending to or near the wall of the other member, and a discharge space being formed wherein a discharge path folded by means of the grooves is present, the walls of the discharge space being substantially entirely coated with luminescent material, characterized in that said intervening portions located between the grooves face and extend parallel to the wall of the other member, these intervening portions and the adjacent portions of the other member located opposite to the intervening portions being free from luminescent material, said intervening portions being exposed to light from said discharge space which is substantially all visible light.

2. A low-pressure mercury vapor discharge lamp as claimed in claim 1, characterized in that a gap of not more than 2.0 mm is present between each intervening portion and its associated adjacent portions of the wall of the other member.

3. A low-pressure mercury vapor discharge lamp as claimed in claim 1 characterized by a single groove of a helical shape.

4. A low-pressure mercury vapor discharge lamp as claimed in Claim 1 wherein said lamp is elongate and is characterized by a plurality of said grooves each of which extends substantially in the longitudinal direction of the lamp.

5. A low-pressure mercury vapor discharge lamp as claimed in claim 1, 2, 3 or 4, characterized in that the inner member is provided with grooves and in that the outer member is generally cylindrical.

6. A low-pressure mercury vapor discharge lamp as claimed in claim 5, characterized in that, measured along the circumference of the inner member, the width of the grooves is substantially equal to the width of said intervening portions.

7. A low-pressure mercury vapor discharge lamp as claimed in claim 6, characterized in that a light-reflective member is disposed in the inner member.

8. A low pressure mercury vapor discharge lamp as claimed in claim 7, characterized in that the reflecting member includes flutes promiate to the intervening portions and said flutes extend in the longitudinal direction.

9. A low-pressure mercury vapor discharge lamp as claimed in claim characterized in that an electric stabilization ballast is disposed within the reflecting member.

10. A low-pressure mercury vapor discharge lamp as claimed in one or more of the preceding Claims, characterized in that the end faces and/or the wall portions, located opposite the end faces, of the other member, have a refraction profile.

* * * * *